US007402003B2

(12) United States Patent
Kundel, Sr.

(10) Patent No.: US 7,402,003 B2
(45) Date of Patent: Jul. 22, 2008

(54) TRENCH BOX MOVING APPARATUS AND METHOD

(76) Inventor: Robert Kundel, Sr., 2186 Howland Wilson Rd., Cortland, OH (US) 44410

( * ) Notice: Subject to any disclaimer, the term of this patent is extended or adjusted under 35 U.S.C. 154(b) by 306 days.

(21) Appl. No.: 11/445,878

(22) Filed: Jun. 2, 2006

(65) Prior Publication Data

US 2008/0050213 A1 Feb. 28, 2008

(51) Int. Cl.
*E02D 17/00* (2006.01)

(52) U.S. Cl. ..... 405/283; 405/282; 405/272; 405/157

(58) Field of Classification Search ..... 405/282, 405/283, 272, 274, 157; 37/403, 468, 407, 37/903; 414/723
See application file for complete search history.

(56) References Cited

U.S. PATENT DOCUMENTS 4,019,329 A 4/1977 Griswold
4,058,983 A 11/1977 Griswold
4,714,381 A * 12/1987 Hatch ..... 405/178
5,336,023 A 8/1994 Burdine
5,533,838 A 7/1996 Kundel
5,669,738 A 9/1997 Kundel
5,735,642 A * 4/1998 Barringer ..... 405/282
5,931,608 A 8/1999 Wilkinson
6,007,271 A 12/1999 Cole et al.
6,443,665 B1 9/2002 Kundel, Sr.
6,808,360 B1 10/2004 Patterson

* cited by examiner

*Primary Examiner*—David J. Bagnell
*Assistant Examiner*—Sean D Andrish
(74) *Attorney, Agent, or Firm*—Robert J. Herberger

(57) ABSTRACT

There is disclosed an apparatus and method for moving with an excavator arm a trench box having a pair of adjacent spreader bars at a forward end. The apparatus has a bracket end for connecting to the excavator arm and a hooking fork. The hooking fork has a first surface that engages the first spreader bar of the trench box. The apparatus also includes a second surface for engaging the adjacent second spreader bar when used to lift the trench box from the trench or move the trench box along the trench floor.

19 Claims, 3 Drawing Sheets

TRENCH BOX MOVING APPARATUS AND METHOD

FIELD OF THE INVENTION

The present invention generally relates to trench boxes and methods for moving same. This invention further relates to an apparatus for lifting a trench box out of a construction trench, or sliding or pushing a trench box along the floor of the trench with an attachment to the arm of an excavator.

BACKGROUND OF THE INVENTION

Numerous assemblies have been conceived for shoring the sidewalls to a construction trench. Griswold U.S. Pat. Nos. 4,019,329 and 4,058,983, for example, both disclose a box-like construction, with a pair of spaced apart sidewalls for vertical disposition in a newly dug trench or ditch. A plurality of spreader pipes connect the sidewalls while allowing for some limited pivotal movement therebetween. To remove an assembled Griswold box from its trench after project completion, a plurality of lifting rings 82 are provided for sliding along one or more spreader pipes 18 of this prior art configuration. With a crane hook and some cable threaded through its lifting rings, the Griswold apparatus can be extracted from the hole in which it was used.

An improvement to basic trench box designs is disclosed in Kundel U.S. Pat. Nos. 5,533,838 and 5,669,738. Therein, a modular trench box design can be assembled from a plurality of vertical sheeting panels slid downwardly into a spaced-apart guide frame. In order to remove this box design from its trench after project completion, there are provided aligned circular apertures and inserts on multiple upper sheeting panels. A lifting insert fits in said apertures for removing the trench box with a crane or other mechanical lifting apparatus.

A further improvement to trench box designs is shown and described in Kundel U.S. Pat. No. 6,443,665. For this design, a plurality of stacked panels 20 are slid downwardly over a hook or J-shaped connector at opposite ends of each panel to form a pair of trench box sidewalls spaced apart by support bars 50. Once fully assembled, this box is moved into proper position in a trench with chains hooked through D-rings 37 on the connector frames using the boom of a backhoe. Thereafter, the chains are removed and the box pound down into its desired depth in the trench.

Another more mechanically complicated trench box configuration entails a shape with sidewalls, through which conduit may be continuously laid. The separated sides to the box and method of Hatch U.S. Pat. No. 4,714,381 may be advanced by pulling the box forward and tapping it down at one end with the arms of an excavator. Burdine U.S. Pat. No. 5,336,023 teaches a self-propelled trench box having rotatable drive tracks hydraulically driven like the tracks on a military tank. Multiple lift tubes 48 on each sidewall panel serve as lifting locations for removing the box from its trench by hook up to a crane or backhoe. And finally, Wilkinson U.S. Pat. No. 5,931,608 shows a trench shoring transport device that includes a wheeled frame. Below that frame which is adjustable in width, there is suspended one or more trench boxes that can be raised at opposite ends with one or more hydraulic arms. In one preferred embodiment, these hydraulic arms remain attached to respective auxiliary spreaders at opposite trench box ends.

At the present time, there are no easily adaptable attachments for the arm of an excavator for lifting and/or moving a trench box from a first position to a second position along the trench. In any cases, an excavated trench tends to be substantially elongated and continuous in order to lay utilities, such as, for example, lengths of water lines, sewer pipe, cable or electric lines. After work within the immediate trench box area has been completed and the box should be moved along the length of the trench, but not yet fully re-moved from the trench, workers have been observed using the excavator shovel or bucket end to forcibly push or pull the box forward, along the substantially horizontal trench floor. Sometimes, the excavator bucket face (or teeth end) is used for partially lifting the box up and away from the mud of trench sidewalls and/or floor. Then with these same bucket teeth, the trench box proper is either pulled toward or pushed away by the excavator arm. That prior practice is fundamentally unsafe. The trench box itself can easily slip from the excavator bucket during transit.

Ideally, what would be desirable is an attaching apparatus to an excavator that easily, yet fairly quickly, secures to the working end of the excavator area. That attachment is shaped so that it can be easily maneuvered between the spreader bars at the forward end of a typical trench box design. Then by mere manipulation of the excavator arm, the attaching apparatus is positioned between, then rotated downward so that the lower hook ends of the attachment engage against one of said trench box spreader bars. Another surface of that same attachment contacts with or otherwise engages the adjacent spreader bar for moving the box forward. In a preferred embodiment, this engagement would not have to lock on to any portion of the trench box. On the contrary, after the box has been moved from its first location to its next, the attachment can be easily and rapidly removed from between adjacent spreader bars merely by maneuvering or tilting the excavator arm and attachment backwards a few degrees, then pulling the attachment back, out from between the pair of spreader bars and away from the trench box once relocated at its second working position.

SUMMARY OF THE INVENTION

An object of the present invention is to provide an excavator arm attachment that easily mounts to an excavator that digs trenches for various construction and/or utility servicing applications. That attachment need not be permanently secured to the excavator arm but rapidly connectable to and from same. Such an attachment should be easy to use and yet outperform (for safety and speed) the alternative of merely moving a trench box along using the bucket teeth or face otherwise attached to that same excavator arm.

Another object of this invention is to provide an attachment that more safely transports (or moves) an assembled trench box from a first working position to a second working position along the same, substantially horizontal trench floor. Even though the attachment needs connecting to an excavator arm after a sufficient length of working trench has been dug and cleared away, the ease of operating this attachment and the means by which it more safely and accurately moves assembled boxes along their trench box floor should soon make this attachment part of the excavator operator's standard equipment.

These and other advantages of the present invention are achieved with an apparatus and method for moving, with an excavator arm, a trench box having a pair of adjacent spreader bars at one or both ends. The apparatus may have face-plate with a bracket side for connecting to the excavator arm and a trench box engagement side having at least a pair of spaced apart, hooking forks. The hooking fork engages with both a first spreader bar of the box and an adjacent second spreader bar when used to move the trench box along the trench floor.

BRIEF DESCRIPTION OF THE DRAWINGS

Further features, objectives and advantages of the present invention will become clearer when referring to the following detailed description of the preferred embodiments made with reference to the accompanying drawings in which.

DETAILED DESCRIPTION OF PREFERRED EMBODIMENTS

Figure 1:
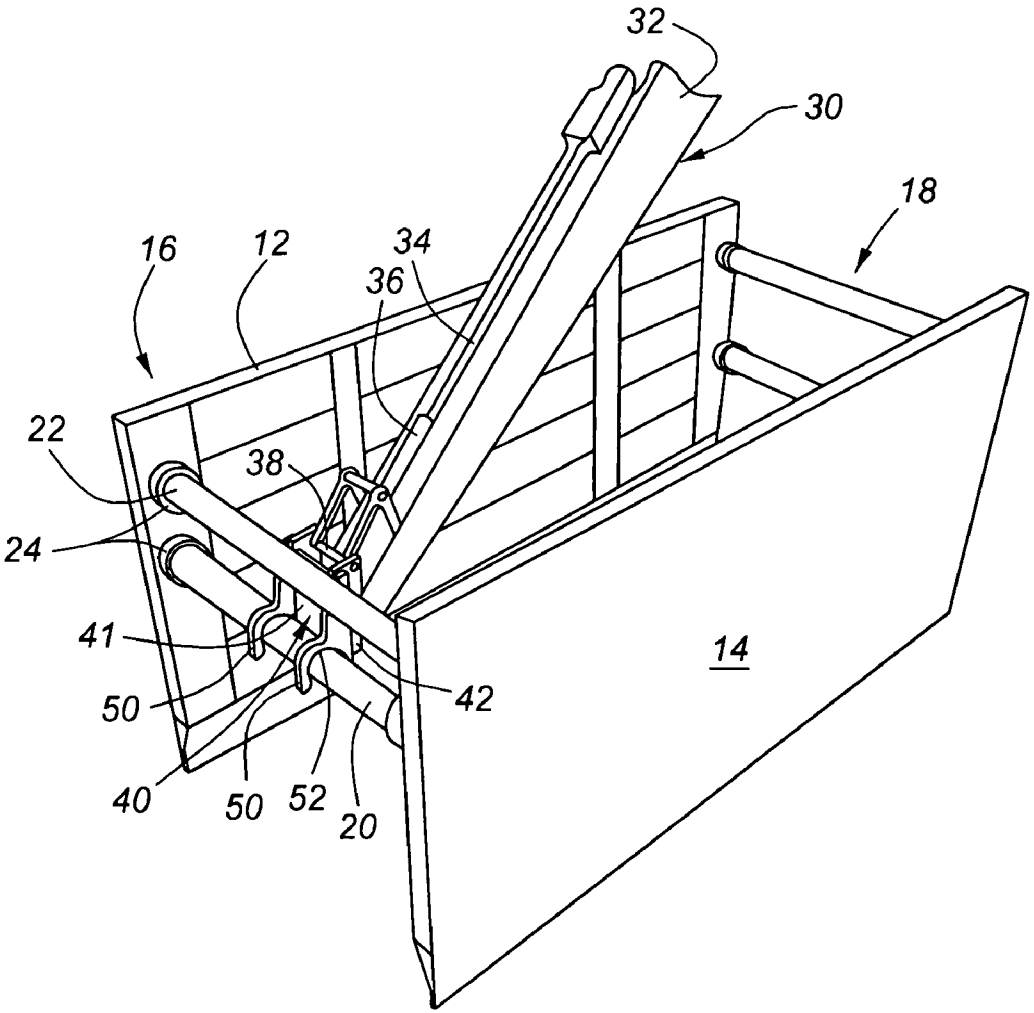
FIG. 1 is a perspective view of one embodiment of the apparatus according to this invention attached to the arm of a typical construction excavator (partially shown) and positioned between adjacent spreader bars of an assembled trench box.

Referring now to the accompanying Figures, there is shown a preferred embodiment of the trench box moving apparatus according to the present invention. In these Figures, the trench box 10 being moved consists of left and right sidewalls 12 and 14, respectively, held apart at the forward end of the box with a plurality of preferably cylindrical spreader bars 20, 22. As shown, trench box 10 includes a pair of spreader bars at both its forward end 16 and rear end 18.

The pair of spreader bars critical for moving the trench box 10 according to this invention is in most cases substantially oriented vertically, with the lower or first forward spreader bar 20 at the front end 16 of the trench box 10 being situated a set distance directly below the upper or second forward spreader bar 22. In many commercial varieties of trench boxes, the first and second spreader bars at the forward end are typically spaced vertically at a distance ranging anywhere from about 17 to 43 inches (from center to center of each spreader bar). More frequently, the set distance between the first spreader bar 20 and the second spreader bar 22 is about 19 inches (again, measuring center to center). Typically, the spreader bars 20, 22 have a diameter between 4 to 10 inches, with the preferred diameter being 8 inches.

In the embodiments depicted in the accompanying Figures, each of the spreader bars at both the forward and rear ends (16 and 18, respectively) of trench box 10 are cylindrical tubes that can be made to create a trench box with an adjustable width between. These spreader bars each connect to their respective trench box sidewalls with a bar-to-box fitting 24 standard for the industry.

The apparatus of this invention is meant for first connecting to an excavator, generally 30. The extendable lift arm 32 of that excavator is partially shown in some of the Figures. It typically includes a hydraulic cylinder 34 from which a hydraulic piston 36 extends and retracts. With such movement, the excavator operator can cause the lift arm 32 to move the lift arm link pins 38 back and forth. When connected to a typical excavator bucket (via bucket links and pins), the excavator operator can force the teeth of a typical bucket attachment downwardly for digging out the trench in which persons may perform their assigned tasks.

In one preferred embodiment of this invention, apparatus 40 has an excavator arm connecting mechanism, or bracket end 42 extending from one side of a face-plate 41. The bracket end 42 includes a plurality of apertures 44 through which link pins 38 extend for at least temporarily connecting the apparatus 40 to the lift arm 32. Link pins 38 are preferably quick disconnecting bolts or pins. However, a standard threaded nut and bolt or locking pin can be used in place of each quick disconnect.

A preferred embodiment of the apparatus 40 has, on the opposite side of the face-plate 41 from the bracket end 42, a plurality of hooking forks 50. As shown in the Figures, apparatus 40 has two spaced apart hooking forks 50, though it is to be understood that the apparatus may have more than two spaced forks, or it could have one continuously wide fork that extends along the length of an engagement region 58 (shown by broken line between the sidewalls 12, 14) of the forward-most, first spreader bar 20 when used to move the trench box 10 according to the invention. Further, each hooking fork 50 has a lower arcuate or arch-like engagement surface 52. That surface serves to engage the outer perimeter of the first spreader bar 20 at the first spreader bar engagement region 58. Ideally, with the cylindrically shaped first spreader bar 20, the lower arch-like engagement surface 52 confines the first spreader bar 20 and limits forward and backward movement of the apparatus 40 relative thereto.

Figure 2:
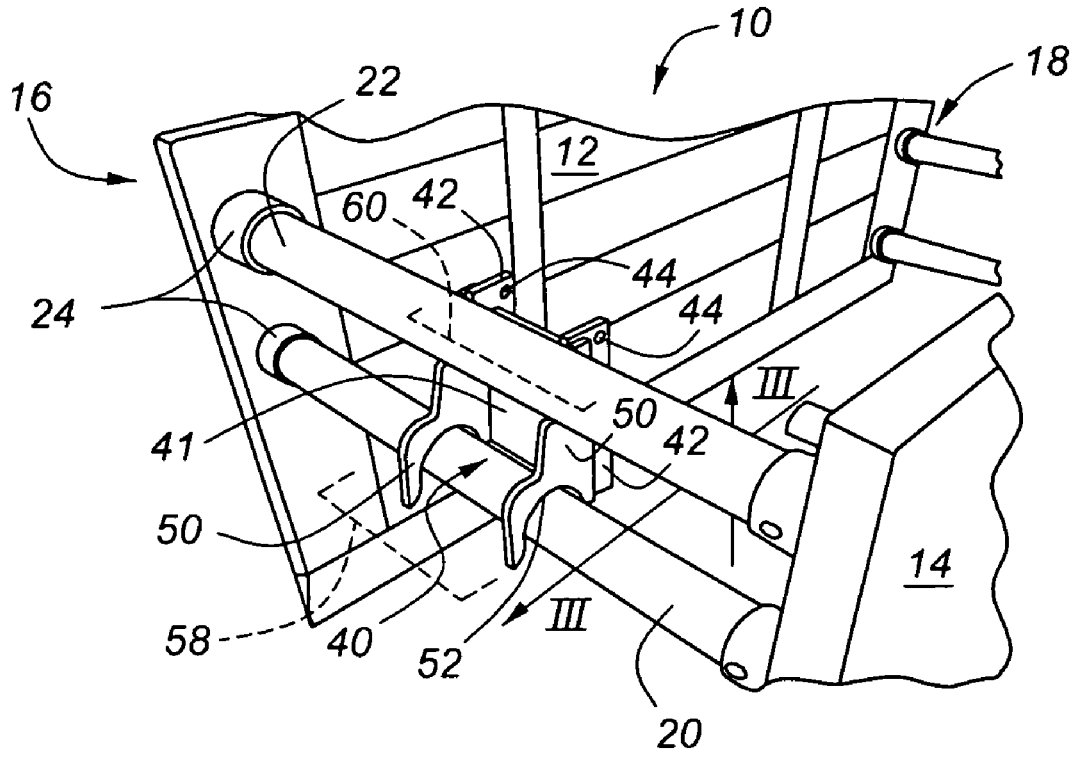
FIG. 2 is a closer perspective view of the apparatus from FIG. 1, positioned over the lower spreader bar of the trench box but with the excavator arm removed for easier viewing.
Figure 3:
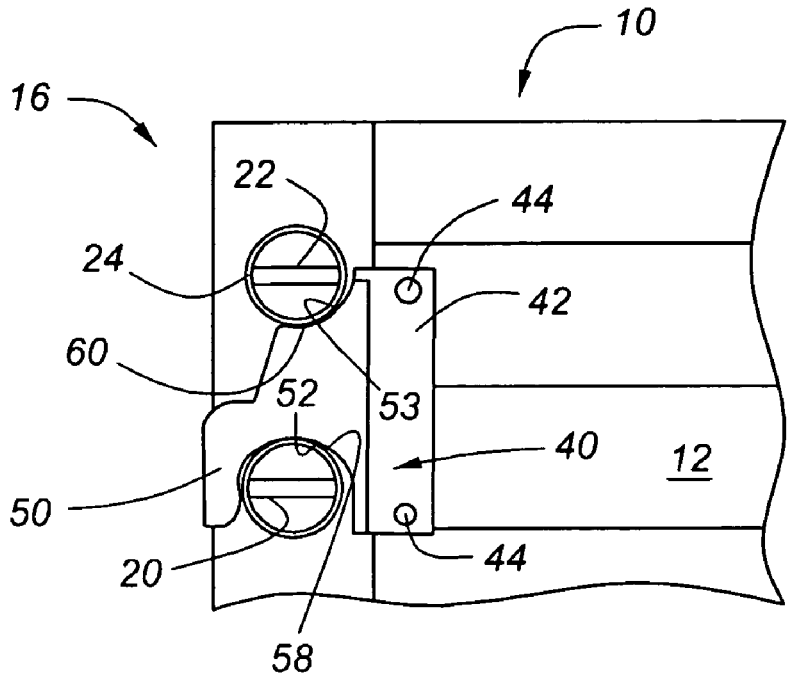
FIG. 3 is a side elevational view of the apparatus positioned between trench box spreader bars taken from a planar view along intersecting lines III-III of FIG. 2.
Figure 4:
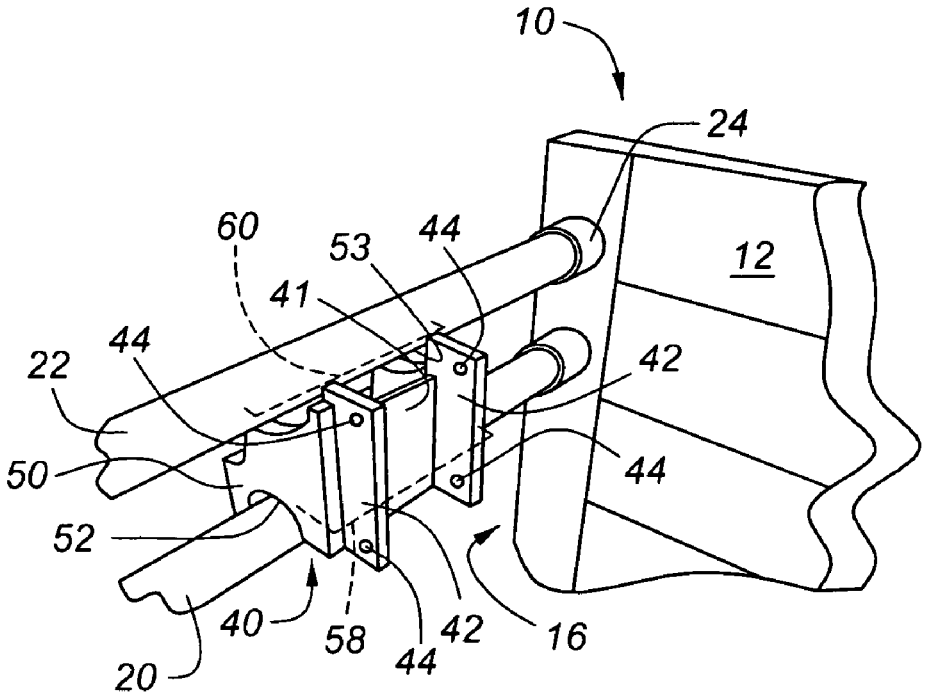
FIG. 4 is an opposite perspective view from FIG. 2 showing the apparatus (without the excavator arm) engaged over the lower spreader bar and under the upper spreader bar of the trench box.

In FIG. 3, there is best seen from the elevational side view, the upper engagement surface 53, which is substantially concave as it is meant to serve as the vertical lifting point for the apparatus 40, when rotated forward with the lift arm of an excavator (not shown) to engage beneath and to a side of the second spreader bar 22 at the second engagement region 60. Still further referring to FIG. 2, it can be seen from the perspective view the extent to which an upper end engagement surface 53 to each hooking fork 50 is positioned relative to a second engagement region 60 of the second spreader bar 22 of trench box 10.

In these embodiments, first spreader bar 20 is located substantially directly below the second spreader bar 22. Should a trench box employ an alternative geometry, the side views to an alternate embodiment of this invention can be similarly modified so as to compliment the location and relationship of the first spreader bar engagement region 58 relative to the second spreader bar engagement region 60. Further, it is to be understood, should the cross-sectional shape of the spreader bars be other than circular, the lower and upper engagement surfaces 52 and 53, respectively, can be modified to best complement the different shape. Still further, though preferred, the first spreader bar engaging region 58 does not always have to serve as a substantially horizontal stopping region for the apparatus, and the second spreader bar engagement region 60 does not always have to serve as a substantially vertical lifting point for the apparatus. Instead, they can be interchanged. Notably, if the arch-like engagement surface is reversibly interchanged with the concave second engagement surface 52, the apparatus would best be used on the spreader bars at the rear 18 of the trench box 10 to take advantage of the torque caused by the weight of the box.

To move a trench box 10 using the apparatus 40, it is anticipated that a team of workers working in the dug trench will first detach the excavator bucket from its lifting arm and connect the apparatus 40. Preferably, the apparatus 40 is temporarily attached to the lifting arm 32 at its bracket end 42 using removable locking pins 38. Then, with nominal movement of the arm 32, apparatus 40 can be fairly easily positioned (or maneuvered), at least partially between the first and second forward spreader bars of trench box 10. By mere rotational and downward movements, the hooking forks 50 of the apparatus 40 are then readily positioned over the first forward spreader bar 20 at the first engagement region 58. As the lifting arm continues to rotate, it then contacts the engagement region 60 of the second spreader bar 22. After the apparatus has been safely guided between the adjacent spreader bars 20, 22 at the forward end 16 to this trench box, raising and extending the excavator arm outward (that is, away from the direction of the excavator operator) will cause the trench box to lift and advance, along the trench floor from a first working location to the desired second location. It is important to note, as the engaged apparatus is raised by the excavator arm, the torque caused by the weight of the trench box is used to further force the apparatus against the spreader bars, thereby sustaining the "grip" of the apparatus with the box in the lifting and moving process.

Once the trench box is positioned at the desired second location, the excavator operator simply rotates the apparatus in the opposite rotational direction to disengage the hooking forks 50, then slightly lifts and withdraws the apparatus from between and away from the forward spreader bars 20, 22. Next, by removing the link pins 38, the apparatus is easily removed from the excavator arm and replaced with the next needed attachment.

In some respects, the apparatus and method of this invention are best suited for pushing the trench box along its trench floor, as well as lifting the trench box from the trench, with the arm of an excavator. And, because the apparatus is only temporarily substituted for the excavator bucket, the trench box can be more safely and accurately repositioned in and around the trench than by an operator who only uses that very same bucket to crudely nudge the trench box along the trench floor.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. A trench box moving apparatus for moving from a first location to a second location a trench box having two or more adjacent spreader bars at a forward end using an excavator having an arm, said apparatus comprising:

a bracket end for connecting to the arm of the excavator; and hooking fork, having a first spreader bar engagement surface and a second spreader bar engagement surface, each spreader bar engagement surface having a shape that compliments a shape of at least a portion of an engagement region of its corresponding spreader bar.

2. The apparatus of claim 1, wherein the first spreader bar engagement surface is shaped to complement the shape of the first spreader bar.

3. The apparatus of claim 2, wherein the second spreader bar engagement surface is shaped to complement at least a portion of the second spreader bar.

4. The apparatus of claim 1, wherein the first spreader bar engagement surface of said hooking fork includes an arcuate surface for engaging the first spreader bar.

5. The apparatus of claim 4, wherein the second spreader bar engagement surface of said hooking fork has a concave shape for engaging at least a portion of the second spreader bar.

6. The apparatus of claim 1, wherein said bracket end of the apparatus includes a plurality of apertures through which the apparatus may be removably pinned to the excavator arm.

7. The apparatus of claim 6, wherein said first and second spreader bar engagement surfaces are spaced to correspond with the distance between the first and second spreader bars.

8. The apparatus of claim 7 further comprises a second hooking fork.

9. The apparatus of claim 8, wherein the first and second hooking forks extend from one side of a face-plate and the bracket end of the apparatus extends from an opposite side of the face-plate.

10. The apparatus of claim 8, wherein at least one of said first and second spreader bar engagement surfaces is substantially arch-shaped.

11. A trench box moving apparatus for moving with an excavator a trench box having at least two spreader bars at a forwardmost end, said spreader bars being substantially vertically aligned a distance apart, said apparatus comprising:

a plate having a bracket side for connecting to an arm of the excavator; and at least two spaced apart, hooking forks, each hooking fork having a first surface for contacting the lower vertically aligned spreader bar and a second surface for contacting the upper vertically aligned spreader bar when the apparatus is connected to the excavator arm and positioned between said spreader bars for moving the trench box from a first location to a second location.

12. The apparatus of claim 11, wherein said bracket end includes a plurality of apertures through which the apparatus may be releasably secured to the excavator arm.

13. The apparatus of claim 11, wherein the first and second contacting surfaces of each hooking fork are spaced to complement the distance between the substantially vertically aligned, forwardmost spreader bars of the trench box.

14. The apparatus of claim 11, wherein the second contacting surface of each hooking fork includes a shape to complement at least a portion of a cross-sectional shape of the second spreader bar.

15. The apparatus of claim 11, wherein at least one of the first and second spreader bar engagement surfaces is concave.

16. The apparatus of claim 15, wherein at least one of said first and second spreader bar engagement surfaces is substantially arch-shaped.

17. A method for moving a trench box from a first location to a second location using an excavator, the trench box having a forward end with first and second spreader bars, said method comprising:

(a) connecting to an arm of the excavator an apparatus having a hooking fork, the hooking fork having upper and lower spreader bar engagement surfaces for engaging the spreader bars of the trench box;

(b) positioning the apparatus with the excavator arm at least partially between the first and second spreader bars of the trench box;

(c) maneuvering the lower spreader bar engagement surface of the hooking fork of the apparatus to engage the first spreader bar;

(d) rotating the apparatus until the upper spreader bar engagement surface of the hooking fork engages the second spreader bar; and (e) advancing the excavator arm to move the trench box from the first location to the second location.

18. The method of claim 17, wherein step (e) further comprises lifting the excavator arm to raise the trench box at least slightly.

19. A method for moving a trench box having at least two substantially vertically oriented forward spreader bars using an excavator arm, said method comprising:

(a) positioning between the spreader bars of the trench box an apparatus connected to the excavator arm, said apparatus having at least two spaced apart hooking forks with each hooking fork having an upper and a lower spreader bar engagement surface;

(b) rotating the apparatus with the excavator arm so that the lower spreader bar engagement surface of each hooking fork engages one of the spreader bars and the upper spreader bar engagement surface of each hooking fork engages the other spreader bar; and (c) maneuvering the excavator arm to move the trench box from a first location to a second location.

* * * * *